US008496052B2

(12) United States Patent
Frazier

(10) Patent No.: US 8,496,052 B2
(45) **Date of Patent: *Jul. 30, 2013**

(54) BOTTOM SET DOWN HOLE TOOL

(75) Inventor: W. Lynn Frazier, Corpus Christi, TX (US)

(73) Assignee: Magnum Oil Tools International, Ltd., Corpus Christi, TX (US)

( * ) Notice: Subject to any disclaimer, the term of this patent is extended or adjusted under 35 U.S.C. 154(b) by 258 days.

This patent is subject to a terminal disclaimer.

(21) Appl. No.: 12/317,497

(22) Filed: Dec. 23, 2008

(65) Prior Publication Data

US 2010/0155050 A1 Jun. 24, 2010

(51) Int. Cl.
*E21B 33/129* (2006.01)
*E21B 23/06* (2006.01)

(52) U.S. Cl.
USPC ..... 166/124; 166/181; 166/188

(58) Field of Classification Search
USPC ..... 166/123, 124, 181, 182, 188
See application file for complete search history.

(56) References Cited

U.S. PATENT DOCUMENTS

| | | | |
|---|---|---|---|
| RE17,217 | E | 2/1929 | Burch |
| 2,040,889 | A | 5/1936 | Whinnen |
| 2,160,228 | A | 5/1939 | Pustmueller |
| 2,223,602 | A | 12/1940 | Cox |
| 2,230,447 | A | 2/1941 | Bassinger |
| 2,286,126 | A | 6/1942 | Thornhill |
| 2,331,532 | A | 10/1943 | Bassinger |
| 2,376,605 | A | 5/1945 | Lawrence |
| 2,555,627 | A | 6/1951 | Baker |
| 2,589,506 | A | 3/1952 | Morrisett |
| 2,593,520 | A | 4/1952 | Baker et al. |
| 2,616,502 | A | 11/1952 | Lenz |
| 2,640,546 | A | 6/1953 | Baker |

(Continued)

FOREIGN PATENT DOCUMENTS

| | | |
|---|---|---|
| GB | 914030 | 12/1962 |
| WO | WO2010127457 | 11/2010 |

OTHER PUBLICATIONS

"Teledyne Merla Oil Tools-Products-Services," Teledyne Merla, Aug. 1990 (40 pages).

(Continued)

*Primary Examiner* — Shane Bomar
*Assistant Examiner* — Robert E Fuller
(74) *Attorney, Agent, or Firm* — G. Turner Moller

(57) ABSTRACT

A flow back plug, a bridge plug, a ball drop plug and plug with a disintegratable check therein are made from a common subassembly including, in some embodiments, a mandrel, a slips/seal section, a setting assembly and a mule shoe. In other embodiments, the common components are a mandrel, a slips/seal section and a mule shoe. To make the flow back plug, a ball check is placed in the mule shoe. To make the bridge plug, an obstruction is inserted in the mule shoe. To make the ball drop plug, the mule shoe is left unobstructed so any ball dropped in a well seats in a tapered inlet to the mandrel. To make a plug with a disintegratable check, a ball dropped in the well is of a type that disintegrated in frac liquids. The setting assembly includes a setting rod connected to a setting device in the mandrel passage. When the plug is expanded into sealing engagement with a production string, the setting rod pulls out of the setting device leaving a passage through the mandrel and through the setting device. Another embodiment is an improved adapter sleeve used on conventional setting tools.

21 Claims, 4 Drawing Sheets

U.S. PATENT DOCUMENTS

| | | | | | |
|---|---|---|---|---|---|
| 2,713,910 | A | | 7/1955 | Baker et al. | |
| 2,741,932 | A | | 8/1955 | Thompson | |
| 2,737,242 | A | * | 3/1956 | Baker | 166/123 |
| 2,756,827 | A | | 7/1956 | Farrar | |
| 2,830,666 | A | | 4/1958 | Rhodes | |
| 2,833,354 | A | | 5/1958 | Sailers | |
| 3,013,612 | A | | 12/1961 | Angel | |
| 3,054,453 | A | | 9/1962 | Bonner | |
| 3,062,296 | A | | 11/1962 | Brown | |
| 3,082,824 | A | * | 3/1963 | Taylor | 166/134 |
| 3,094,166 | A | * | 6/1963 | McCullough | 166/63 |
| 3,160,209 | A | * | 12/1964 | Bonner | 166/63 |
| 3,163,225 | A | | 12/1964 | Perkins | |
| 3,273,588 | A | | 9/1966 | Dollison | |
| 3,282,342 | A | | 11/1966 | Mott | |
| 3,291,218 | A | | 12/1966 | LeBourg | |
| 3,298,437 | A | | 1/1967 | Conrad | |
| 3,298,440 | A | | 1/1967 | Current | |
| 3,306,362 | A | | 2/1967 | Urbanosky | |
| 3,308,895 | A | | 3/1967 | Oxford et al. | |
| 3,356,140 | A | | 12/1967 | Young | |
| 3,393,743 | A | | 7/1968 | Stanescu | |
| 3,429,375 | A | | 2/1969 | Craig | |
| 3,517,742 | A | | 6/1970 | Williams | |
| 3,554,280 | A | | 1/1971 | Tucker | |
| 3,602,305 | A | * | 8/1971 | Kisling, III | 166/134 |
| 3,623,551 | A | | 11/1971 | Randermann, Jr. | |
| 3,687,202 | A | | 8/1972 | Young et al. | |
| 3,787,101 | A | | 1/1974 | Sugden | |
| 3,818,987 | A | | 6/1974 | Ellis | |
| 3,851,706 | A | | 12/1974 | Ellis | |
| 3,860,066 | A | | 1/1975 | Pearce et al. | |
| 3,926,253 | A | | 12/1975 | Duke | |
| 4,035,024 | A | | 7/1977 | Fink | |
| 4,049,015 | A | | 9/1977 | Brown | |
| 4,134,455 | A | | 1/1979 | Read | |
| 4,151,875 | A | | 5/1979 | Sullaway | |
| 4,185,689 | A | | 1/1980 | Harris | |
| 4,189,183 | A | | 2/1980 | Borowski | |
| 4,250,960 | A | | 2/1981 | Chammas | |
| 4,314,608 | A | | 2/1982 | Richardson | |
| 4,381,038 | A | | 4/1983 | Sugden | |
| 4,391,547 | A | | 7/1983 | Jackson, Jr. et al. | |
| 4,405,017 | A | | 9/1983 | Allen et al. | |
| 4,432,418 | A | | 2/1984 | Mayland | |
| 4,436,151 | A | | 3/1984 | Callihan et al. | |
| 4,437,516 | A | * | 3/1984 | Cockrell | 166/120 |
| 4,457,376 | A | | 7/1984 | Carmody et al. | |
| 4,493,374 | A | * | 1/1985 | Magee, Jr. | 166/382 |
| 4,532,995 | A | | 8/1985 | Kaufman | |
| 4,548,442 | A | | 10/1985 | Sugden et al. | |
| 4,554,981 | A | | 11/1985 | Davies | |
| 4,566,541 | A | | 1/1986 | Moussy et al. | |
| 4,585,067 | A | | 4/1986 | Blizzard et al. | |
| 4,595,052 | A | | 6/1986 | Kristiansen | |
| 4,602,654 | A | | 7/1986 | Stehling et al. | |
| 4,688,641 | A | | 8/1987 | Knieriemen | |
| 4,708,163 | A | | 11/1987 | Deaton | |
| 4,708,202 | A | * | 11/1987 | Sukup et al. | 166/123 |
| D293,798 | S | | 1/1988 | Johnson | |
| 4,776,410 | A | | 10/1988 | Perkin et al. | |
| 4,784,226 | A | | 11/1988 | Wyatt | |
| 4,792,000 | A | | 12/1988 | Perkin et al. | |
| 4,830,103 | A | | 5/1989 | Blackwell et al. | |
| 4,848,459 | A | | 7/1989 | Blackwell et al. | |
| 4,893,678 | A | | 1/1990 | Stokley et al. | |
| 5,020,590 | A | | 6/1991 | McLeod | |
| 5,074,063 | A | | 12/1991 | Vannette | |
| 5,082,061 | A | | 1/1992 | Dollison | |
| 5,095,980 | A | | 3/1992 | Watson | |
| 5,113,940 | A | | 5/1992 | Glaser | |
| 5,117,915 | A | | 6/1992 | Mueller et al. | |
| 5,154,228 | A | | 10/1992 | Gambertoglio et al. | |
| 5,183,068 | A | | 2/1993 | Prosser | |
| 5,188,182 | A | | 2/1993 | Echols, III et al. | |
| 5,207,274 | A | | 5/1993 | Streich et al. | |
| 5,209,310 | A | | 5/1993 | Clydesdale | |
| 5,219,380 | A | | 6/1993 | Young et al. | |
| 5,224,540 | A | * | 7/1993 | Streich et al. | 166/118 |
| 5,230,390 | A | | 7/1993 | Zastresek et al. | |
| 5,234,052 | A | | 8/1993 | Coone et al. | |
| 5,253,705 | A | | 10/1993 | Clary et al. | |
| 5,295,735 | A | | 3/1994 | Cobbs et al. | |
| 5,311,939 | A | | 5/1994 | Pringle | |
| 5,316,081 | A | | 5/1994 | Baski et al. | |
| 5,318,131 | A | | 6/1994 | Baker | |
| D350,887 | S | | 9/1994 | Sjolander et al. | |
| 5,343,954 | A | | 9/1994 | Bohlen et al. | |
| D353,756 | S | | 12/1994 | Graves | |
| D355,428 | S | | 2/1995 | Hatcher | |
| 5,390,737 | A | | 2/1995 | Jacobi et al. | |
| 5,392,540 | A | | 2/1995 | Cooper et al. | |
| 5,419,399 | A | | 5/1995 | Smith | |
| RE35,088 | E | | 11/1995 | Gilbert | |
| 5,484,191 | A | | 1/1996 | Sollami | |
| 5,490,339 | A | | 2/1996 | Accettola | |
| 5,540,279 | A | | 7/1996 | Branch et al. | |
| 5,564,502 | A | | 10/1996 | Crow et al. | |
| 5,593,292 | A | | 1/1997 | Ivey | |
| D377,969 | S | | 2/1997 | Grantham | |
| 5,655,614 | A | | 8/1997 | Azar | |
| 5,701,959 | A | | 12/1997 | Hushbeck et al. | |
| 5,785,135 | A | | 7/1998 | Crawley et al. | |
| 5,791,825 | A | | 8/1998 | Gardner et al. | |
| 5,803,173 | A | | 9/1998 | Fraser, III et al. | |
| 5,810,083 | A | | 9/1998 | Kilgore | |
| 5,819,846 | A | | 10/1998 | Bolt, Jr. | |
| D415,180 | S | | 10/1999 | Rosanwo | |
| 5,961,185 | A | | 10/1999 | Friant et al. | |
| 5,984,007 | A | | 11/1999 | Yuan et al. | |
| 5,988,277 | A | | 11/1999 | Vick, Jr. et al. | |
| 6,012,519 | A | | 1/2000 | Allen et al. | |
| 6,085,446 | A | | 7/2000 | Posch | |
| 6,098,716 | A | | 8/2000 | Hromas et al. | |
| 6,105,694 | A | | 8/2000 | Scott | |
| 6,142,226 | A | | 11/2000 | Vick | |
| 6,152,232 | A | | 11/2000 | Webb et al. | |
| 6,167,963 | B1 | | 1/2001 | McMahan et al. | |
| 6,182,752 | B1 | | 2/2001 | Smith, Jr. et al. | |
| 6,199,636 | B1 | | 3/2001 | Harrison | |
| 6,220,349 | B1 | | 4/2001 | Vargus et al. | |
| 6,283,148 | B1 | | 9/2001 | Spears et al. | |
| 6,341,823 | B1 | | 1/2002 | Sollami | |
| 6,367,569 | B1 | | 4/2002 | Walk | |
| 6,394,180 | B1 | | 5/2002 | Berscheidt et al. | |
| 6,457,267 | B1 | | 10/2002 | Porter et al. | |
| 6,491,108 | B1 | | 12/2002 | Slup et al. | |
| 6,543,963 | B2 | | 4/2003 | Bruso | |
| 6,581,681 | B1 | | 6/2003 | Zimmerman et al. | |
| 6,629,563 | B2 | | 10/2003 | Doane | |
| 6,695,049 | B2 | | 2/2004 | Ostocke et al. | |
| 6,708,770 | B2 | * | 3/2004 | Slup et al. | 166/387 |
| 6,725,935 | B2 | | 4/2004 | Szarka et al. | |
| 6,739,398 | B1 | | 5/2004 | Yokley et al. | |
| 6,769,491 | B2 | | 8/2004 | Zimmerman | |
| 6,779,948 | B2 | | 8/2004 | Bruso | |
| 6,796,376 | B2 | | 9/2004 | Frazier | |
| 6,799,633 | B2 | | 10/2004 | McGregor | |
| 6,834,717 | B2 | | 12/2004 | Bland | |
| 6,851,489 | B2 | | 2/2005 | Hinds | |
| 6,854,201 | B1 | | 2/2005 | Hunter et al. | |
| 6,902,006 | B2 | | 6/2005 | Myerley et al. | |
| 6,918,439 | B2 | | 7/2005 | Dallas | |
| 6,938,696 | B2 | | 9/2005 | Dallas | |
| 6,944,977 | B2 | | 9/2005 | Deniau et al. | |
| 7,021,389 | B2 | | 4/2006 | Bishop | |
| 7,040,410 | B2 | | 5/2006 | McGuire et al. | |
| 7,055,632 | B2 | | 6/2006 | Dallas | |
| 7,069,997 | B2 | | 7/2006 | Coyes et al. | |
| 7,107,875 | B2 | | 9/2006 | Haugen et al. | |
| 7,124,831 | B2 | | 10/2006 | Turley et al. | |
| 7,128,091 | B2 | | 10/2006 | Istre | |
| 7,150,131 | B2 | | 12/2006 | Barker | |
| 7,168,494 | B2 | | 1/2007 | Starr et al. | |
| 7,281,584 | B2 | | 10/2007 | McGarian et al. | |
| D560,109 | S | | 1/2008 | Huang et al. | |
| 7,325,617 | B2 | | 2/2008 | Murray | |

| | | | | |
|---|---|---|---|---|
| 7,337,847 | B2 | 3/2008 | McGarian et al. | |
| 7,350,582 | B2 | 4/2008 | McKeachnie | |
| 7,353,879 | B2 | 4/2008 | Todd et al. | |
| 7,363,967 | B2 | 4/2008 | Burris, II et al. | |
| 7,373,973 | B2 | 5/2008 | Smith et al. | |
| 7,428,922 | B2 * | 9/2008 | Fripp et al. | 166/66.5 |
| 7,527,104 | B2 | 5/2009 | Branch et al. | |
| 7,552,779 | B2 | 6/2009 | Murray | |
| D597,110 | S | 7/2009 | Anitua Aldecoa | |
| 7,600,572 | B2 | 10/2009 | Slup et al. | |
| 7,604,058 | B2 | 10/2009 | McGuire | |
| 7,637,326 | B2 | 12/2009 | Bolding et al. | |
| 7,644,767 | B2 | 1/2010 | Kalb et al. | |
| 7,644,774 | B2 | 1/2010 | Branch et al. | |
| D612,875 | S | 3/2010 | Beynon | |
| 7,673,677 | B2 | 3/2010 | King et al. | |
| 7,690,436 | B2 * | 4/2010 | Turley et al. | 166/387 |
| D618,715 | S | 6/2010 | Corcoran | |
| 7,735,549 | B1 | 6/2010 | Nish et al. | |
| 7,740,079 | B2 * | 6/2010 | Clayton et al. | 166/387 |
| 7,775,286 | B2 | 8/2010 | Duphorne | |
| 7,775,291 | B2 | 8/2010 | Jacob | |
| 7,784,550 | B2 | 8/2010 | Nutley et al. | |
| 7,798,236 | B2 | 9/2010 | McKeachnie et al. | |
| 7,810,558 | B2 | 10/2010 | Shkurti et al. | |
| D629,820 | S | 12/2010 | Van Ryswyk | |
| 7,866,396 | B2 | 1/2011 | Rytlewski | |
| 7,878,242 | B2 | 2/2011 | Gray | |
| 7,886,830 | B2 | 2/2011 | Bolding et al. | |
| 7,900,696 | B1 | 3/2011 | Nish et al. | |
| 7,909,108 | B2 | 3/2011 | Swor et al. | |
| 7,909,109 | B2 | 3/2011 | Angman et al. | |
| D635,429 | S | 4/2011 | Hakki | |
| 7,918,278 | B2 | 4/2011 | Barbee | |
| 7,921,923 | B2 | 4/2011 | McGuire | |
| 7,921,925 | B2 | 4/2011 | Maguire et al. | |
| 7,926,571 | B2 | 4/2011 | Hofman | |
| 8,074,718 | B2 | 12/2011 | Roberts | |
| 8,079,413 | B2 | 12/2011 | Frazier | |
| 8,113,276 | B2 | 2/2012 | Greenlee et al. | |
| 8,127,856 | B1 | 3/2012 | Nish et al. | |
| D657,807 | S | 4/2012 | Frazier | |
| 8,231,947 | B2 | 7/2012 | Vaidya et al. | |
| 2001/0040035 | A1 | 11/2001 | Appleton et al. | |
| 2003/0024706 | A1 | 2/2003 | Allamon | |
| 2003/0188860 | A1 | 10/2003 | Zimmerman et al. | |
| 2004/0150533 | A1 | 8/2004 | Hall et al. | |
| 2005/0173126 | A1 | 8/2005 | Starr et al. | |
| 2006/0001283 | A1 | 1/2006 | Bakke | |
| 2006/0011389 | A1 | 1/2006 | Booth et al. | |
| 2006/0278405 | A1 | 12/2006 | Turley et al. | |
| 2007/0051521 | A1 | 3/2007 | Fike et al. | |
| 2007/0068670 | A1 | 3/2007 | Booth | |
| 2007/0107908 | A1 | 5/2007 | Vaidya et al. | |
| 2007/0227745 | A1 | 10/2007 | Roberts et al. | |
| 2007/0240883 | A1 | 10/2007 | Telfer | |
| 2008/0060821 | A1 | 3/2008 | Smith | |
| 2008/0110635 | A1 | 5/2008 | Loretz et al. | |
| 2009/0044957 | A1 | 2/2009 | Clayton et al. | |
| 2009/0114401 | A1 | 5/2009 | Purkis | |
| 2009/0126933 | A1 | 5/2009 | Telfer | |
| 2009/0211749 | A1 | 8/2009 | Nguyen et al. | |
| 2010/0064859 | A1 | 3/2010 | Stephens | |
| 2010/0084146 | A1 | 4/2010 | Roberts | |
| 2010/0132960 | A1 | 6/2010 | Shkurti et al. | |
| 2010/0155050 | A1 | 6/2010 | Frazier | |
| 2010/0252252 | A1 | 10/2010 | Harris et al. | |
| 2010/0263876 | A1 * | 10/2010 | Frazier | 166/378 |
| 2010/0276159 | A1 | 11/2010 | Mailand et al. | |
| 2010/0288503 | A1 | 11/2010 | Cuiper et al. | |
| 2011/0005779 | A1 | 1/2011 | Lembcke | |
| 2011/0036564 | A1 | 2/2011 | Williamson | |
| 2011/0061856 | A1 | 3/2011 | Kellner et al. | |
| 2011/0088915 | A1 | 4/2011 | Stanojcic et al. | |
| 2011/0103915 | A1 | 5/2011 | Tedeschi | |
| 2011/0168404 | A1 | 7/2011 | Telfer et al. | |
| 2011/0198082 | A1 | 8/2011 | Stromquist et al. | |
| 2011/0240295 | A1 | 10/2011 | Porter et al. | |
| 2011/0259610 | A1 | 10/2011 | Shkurti et al. | |

OTHER PUBLICATIONS

"78/79 Catalog: Packers-Plugs-Completions Tools," Pengo Industires, Inc., 1978-1979 (12 pages).
"MAP Oil Tools Inc. Catalog," MAP Oil Tools, Apr. 1999 (46 pages).
"Lovejoy-where the world turns for couplings," Lovejoy, Inc., Dec. 2000 (30 pages).
"Halliburton Services, Sales & Service Catalog," Halliburton Services, 1970-1971 (2 pages).
"1975-1976 Packer Catalog," Gearhart-Owen Industries Inc., 1975-1976 (52 pages).
"Formation Damage Control Utilizing Composite-Bridge Plug Technology for Monobore, Multizone Stimulation Operations," Gary Garfield, SPE, May 15, 2001 (8 pages).
"Composite Bridge Plug Technique for Multizone Commingled Gas Wells," Gary Garfield, SPE, Mar. 24, 2001 (6 pages).
"Composite Research: Composite bridge plugs used in multi-zone wells to avoid costly kill-weight fluids," Gary Garfield, SPE, Mar. 24, 2001 (4 pages).
"It's About Time-Quick Drill Composite Bridge Plug," Baker Oil Tools, Jun. 2002 (2 pages).
"Baker Hughes-Baker Oil Tools-Workover Systems-QUIK Drill Composite Bride Plug," Baker Oil Tools, Dec. 2000 (3 pages).
"Baker Hughes 100 Years of Service,"Baker Hushes in Depth, Special Centennial Issue, Publication COR-07-13127, vol. 13, No. 2, Baker Hughes Incorporated, Jul. 2007 (92 pages).
"Halliburton Services, Sales & Service Catalog No. 43," Halliburton Co., 1985 (202 pages).
"Alpha Oil Tools Catalog," Alpha Oil Tools, 1997 (136 pages).

* cited by examiner

BOTTOM SET DOWN HOLE TOOL

This invention relates to a tool used in wells extending into the earth and, more particularly, to a series of down hole tools based on a common subassembly.

BACKGROUND OF THE INVENTION

An important development in natural gas production in recent decades, at least in the continental United States, has been the improvement of hydraulic fracturing techniques for stimulating production from previously uneconomically tight formations. For some years, the fastest growing segment of gas production has been from shales or very silty zones that previously have not been considered economic. The current areas of increasing activity include the Barnett Shale, the Haynesville Shale, the Fayetteville Shale, the Marcellus Shale and other shale or shaley formations.

There are a variety of down hole tools used in the completion and/or production of hydrocarbon wells such as bridge plugs, flow back plugs, ball drop plugs and the like. In the past, these have all been tools specially designed for a single purpose.

It is no exaggeration to say that the future of natural gas production in the continental United States is from heretofore uneconomically tight gas bearing formations, many of which are shales or shaley silty zones. Accordingly, a development that allows effective frac jobs at overall lower costs is important.

Disclosures of interest relative to this invention are found in U.S. Pat. Nos. 2,714,932; 2,756,827; 3,282,342; 3,291,218; 3,393,743; 3,429,375; 3,554,280; 5,311,939; 5,419,399; 6,769,491; 7,021,389 and 7,350,582 along with printed patent application 2008/0060821.

SUMMARY OF THE INVENTION

In this invention, there is provided a common subassembly that can easily be assembled with specialty parts to provide a bridge plug, a flow back plug, a ball drop plug, or a plug having a disintegratable ball or plug check. Thus, a variety of down hole tools or plugs may be assembled from common subassembly parts and a few specialty parts that provide the special functions of different plugs. Thus, a supplier does not have to keep so much inventory because one always seems to receive orders for what is in short supply.

The subassembly parts that are common to the down hole plugs disclosed herein are, in some embodiments, a mandrel, the elements of a slips/seal section, a mule shoe and a setting assembly that, when the plug is manipulated by a conventional setting tool, expands the slips/seal section into sealing engagement with the inside of a production or pipe string. An important feature of this subassembly is that manipulating the tool to set the slips creates a passageway through the setting assembly and, in some embodiments, through the plug. This allows the assembly of a bridge plug, a flow back plug, a ball drop plug or a plug having a disintegratable valve simply by the addition of specialized parts.

In some embodiments, the common subassembly is a mandrel, the elements of a slips/seal section and a mule shoe. In these embodiments, the plug is expanded by pulling on the mandrel and/or pushing on the slips/seal section to expand the slips/seal section in a conventional manner. Another embodiment is an improved adapter sleeve used with conventional setting tools to set a plug having an expandable slips/seal section.

It is an object of this invention to provide an improved down hole well plug that is easily adapted to provide different functions.

A more specific object of this invention is to provide an improved down hole plug in which a setting rod is tensioned to set the plug on the inside of a production or pipe string and then pulled out of the plug.

These and other objects and advantages of this invention will become more apparent as this description proceeds, reference being made to the accompanying drawings and appended claims.

DETAILED DESCRIPTION

Figure 1:
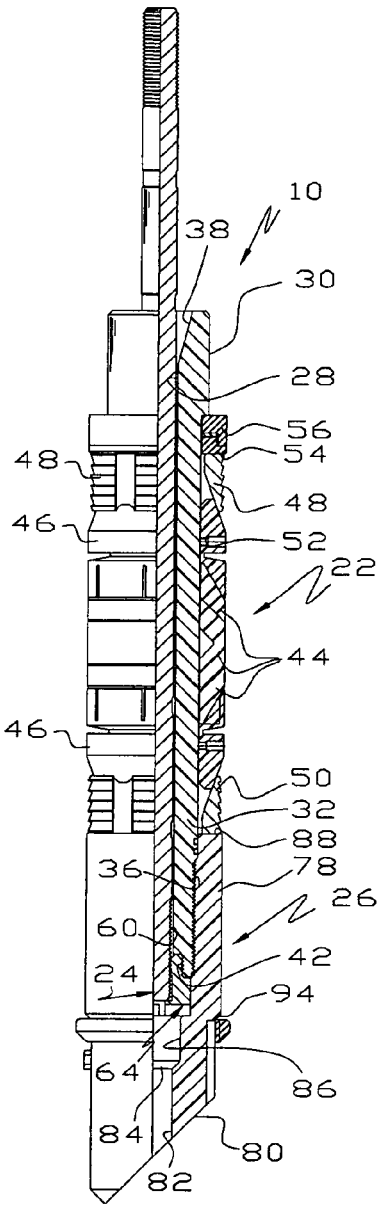
FIG. 1 is a cross-sectional view of a subassembly which is readily modified to act as a variety of tools and which also comprises a ball drop plug, illustrated in a running in or extended position.
Figure 2:
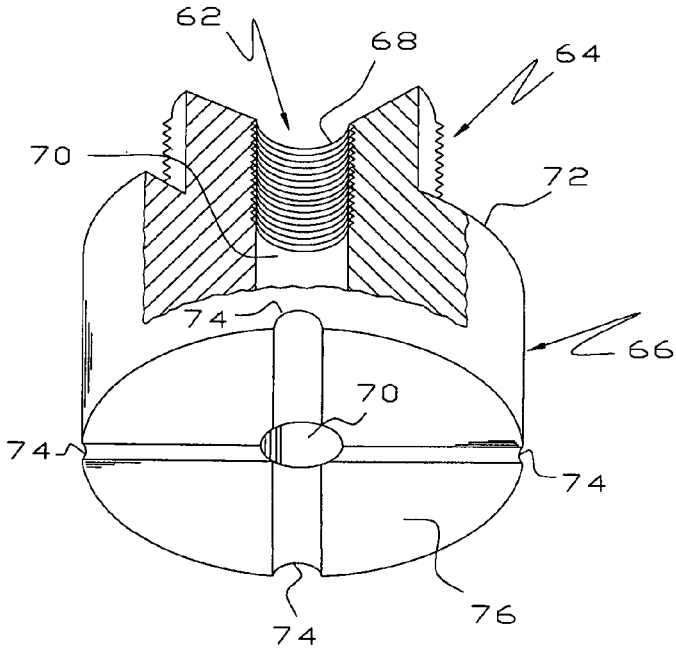
FIG. 2 is an enlarged isometric view, part of which is broken away for clarity of illustration, of a setting device used in the subassembly of FIG. 1.
Figure 3:
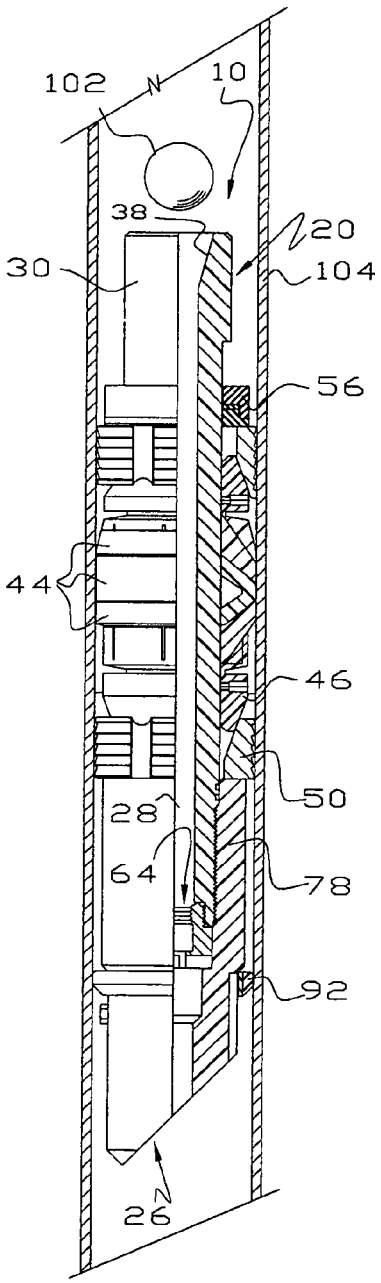
FIG. 3 is a cross-sectional view of the ball drop plug of FIG. 1, illustrated in a set or collapsed position.
Figure 4:
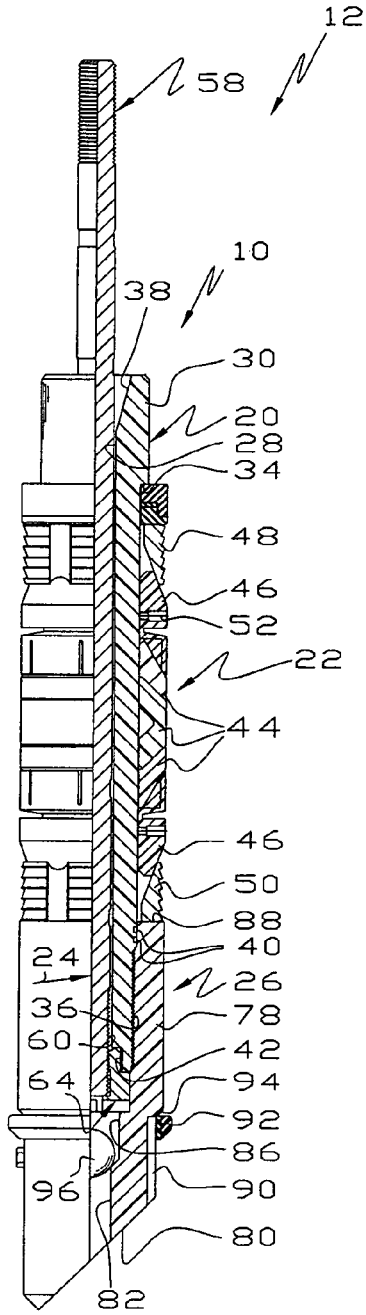
FIG. 4 is a cross-sectional view of a flow back tool, illustrated in a running in or extended position.
Figure 5:
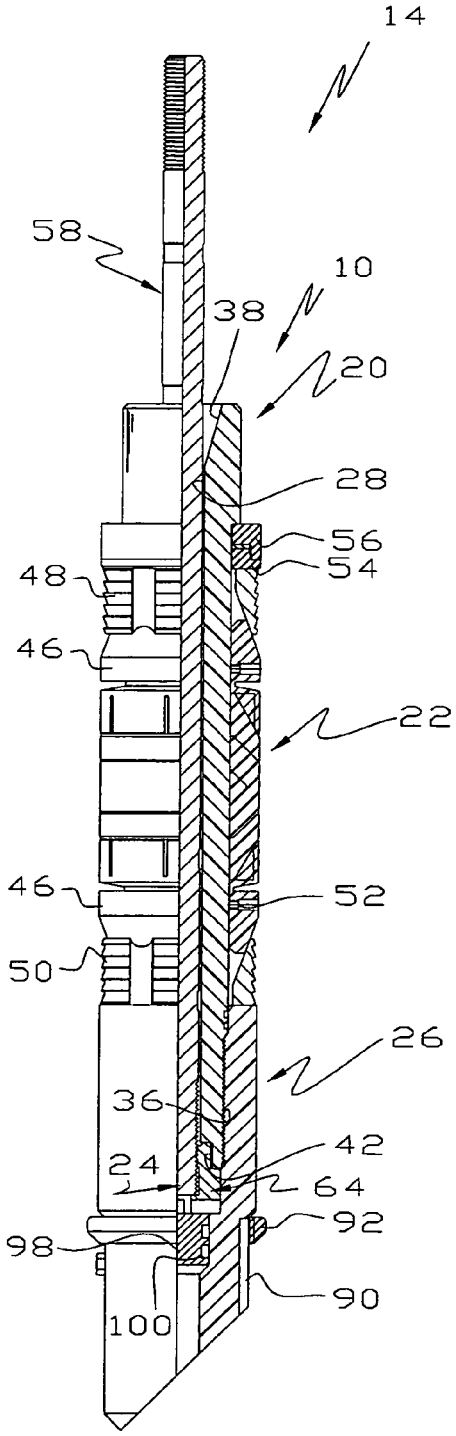
FIG. 5 is an enlarged cross-sectional view of a bridge plug, illustrated in a running in or extended position.

Referring to FIGS. 1-3, there is illustrated a subassembly 10 which is usable, without modification, as a ball drop plug and which may have a few components added to it to provide a flow back plug 12 shown in FIG. 4 or a bridge plug 14 as shown in FIG. 5. The subassembly or ball drop plug 10 comprises, as major components in some embodiments, substantially identical mandrels 20, substantially identical slips/seal sections or assemblies 22, substantially identical setting assemblies 24 and substantially identical mule shoes 26. Because it is often desired to drill out the plugs 10, 12, 14 the components left in the well are typically made of drillable materials, such as composites, plastics, aluminum, bronze or other drillable materials. Composites are well known in the art and can comprise a fabric impregnated with a suitable resin and allowed to dry.

The mandrel 20 provides a central axial passage 28, an upper section 30 and an elongate lower section 32 separated from the upper section 30 by a shoulder 34. The words upper and lower are somewhat inaccurate because they refer to the position of the well tools as if they were in a vertical position while many, if not most, of the plugs disclosed herein will be used in horizontal wells. The words upper and lower are used for purposes of convenience rather than the more accurate, but odd to oil field hands, proximal and distal. The lower end 36 of the lower section 32 is threaded for connection to the mule shoe 26 as will be more fully apparent hereinafter. In some embodiments, the exterior of the lower section 32 is smooth so the slips/seal section or assembly 22 slides easily on it. The passage 28 includes a tapered inlet 38 providing a ball seat for purposes more fully apparent hereinafter. One or more seals 40 can be provided to seal between the mandrel 20 and the mule shoe 26 as is customary in the art. The terminus of the mandrel 20 includes a rabbit or annular notch 42 to receive part of the setting assembly 24 as also will be apparent hereinafter.

The slips/seal section 22 is more-or-less conventional and provides one or more resilient seals 44 and one or more wedge shaped elements 46 which abut wedge shaped slips 48, 50 having wickers or teeth. The elements 46 are conveniently pinned to the mandrel lower section 32 by plastic bolts or pins 52 so the seals 44 and elements 46 stay in place during handling. The plastic bolts 52 are easily sheared during setting of the plugs 10, 12, 14. The upper slips 48 abut a pair of load rings 54, 56 while the lower slips 50 abut a square shoulder provided by the mule shoe 26.

The setting assembly 24 includes a setting rod 58 having a lower threaded end 60 received in a passage 62 provided by a setting device 64. Because the setting rod 58 is removed from the well, in most embodiments it is normally not made of a drillable material and is typically of steel. As most apparent from FIG. 2, the setting device 64 includes a body 66 through which the passage 62 extends completely. The passage 62 has a threaded upper end 68 and a slightly larger lower end 70 which, in some embodiments, is conveniently not threaded. In most embodiments, the threaded end 68 is considerably shorter than the unthreaded lower end 70. The setting device 64 includes a shoulder 72 sized to be received in the rabbit 42 and a series of radiating channels 74 in the bottom wall 76, which have a function in the flow back plug 12 shown in FIG. 4. The setting device 64 is made of a drillable material, usually a metal such as aluminum, brass or bronze.

When setting the plugs 10, 12, 14 the setting tool (not shown) pulls on the setting rod 58 and pushes on the slips/seal section 22 to expand the seals 44 and set the slips 48, 50 against a production or pipe string in the well. It is necessary to pull the rod 58 completely out of the mandrel passage 28 and it is desirable that the rod 58 pull out of the mandrel 20 in response to a predictable force. To this end, the number of threads on the setting rod 50 and/or in the setting device 64 is limited. In other words, if six rounds of threads produce a device having the desired tensile strength, then the threaded end 60 and/or the threaded passage section 62 is made with only six threads. In the alternative, it will be apparent that the rod 58 can be connected to the device 64 in other suitable ways, as by the use of shear pins or the like or the rod 58 can be connected using other releasable techniques to the mandrel 20.

The mule shoe 26 comprises the lower end of the subassembly 10 and includes a body 78 having a tapered lower end 80 and a passage 82 opening through the lower end 80. The passage 82 includes a valve seat 84 which is the lower end of a chamber 86 housing a ball check in the flow back plug 12 of FIG. 4 or an obstruction in the case of the bridge plug 14 of FIG. 5. The mule shoe 26 includes an upper end 88 abutting the bottom of the lower slip 50 and a series of grooves 90 which allow completion fluids to pass more readily around the mule shoe 26 at appropriate times, for example when the plug is being pulled by a wireline upwardly in a liquid filled well. A pump down collar 92 slips over the lower end of the mule shoe 26 and abuts a shoulder 94 so the plug may be pumped into a horizontal leg of a well.

No special components need to be added to the subassembly 10 to provide the ball drop plug. In other words, the ball drop plug and the subassembly 10 are identical. However, in order for the ball drop plug 10 to operate, a ball check 102 is dropped into a production or pipe string 104 to seat against the tapered inlet 38. Those skilled in the art will recognize that the ball drop plug 10 can be used in a situation where a series of zones are to be fraced. There are a number of ways that ball drop plugs are conventionally used, one of which is to frac a zone, run a ball drop plug into the well above the fraced zone, drop a ball 102 into the production string 104 and thereby isolate the lower zone so a higher zone may be fraced.

In order to assemble the flow back plug 12 from the subassembly 10, it is necessary only to insert a ball check 96 into the chamber 86 as the plug 12 is being assembled. It will be apparent to those skilled in the art that the flow back plug 12 is often used in situations where a series of zones are to be fraced in a well. After a zone is fraced, the flow back plug 12 is run into the well and expanded against a production string. The ball check 96 prevents flow through the plug 12 is a downward direction in a vertical well but allows the fraced zone to produce up the production string.

In order to assemble the bridge plug 14, it is necessary only to insert an obstruction 98 into the chamber 86 as the plug 14 is being assembled. In some embodiments, the obstruction 98 includes O-rings or other seals 100 engaging the inside of the chamber 86. It will be seen to those skilled in the art that the bridge plug 14 prevents flow, in either direction, through the plug 14 so the plug 14 is used in any situation where bridge plugs are commonly used.

It will be apparent that the ball check 96 or the ball check 102 may be made of a disintegratable material so the check valve action of these plugs is eliminated over time.

As shown best in FIG. 3, in operation, a conventional setting tool (not shown) such as a Model 10, 20 or E-4 Setting Tool available from Baker Oil Tools, Inc., Houston, Tex., and appropriate connector subs are attached to the setting rod 58 of the plug being set and an annular member (not shown) rides over the upper section 30 of the mandrel 20 to abut the load ring 56, which is the uppermost component of the slips/seat section 22. When this assembly has been lowered to the desired location in a vertical well or pumped to the desired location in a horizontal well, the setting tool is actuated to tension the rod 58 and/or compress the load ring 56. This shears off the plastic screws 52 so the slips 48, 50 slide toward each other on the exterior of the mandrel 20. This forces the resilient seals 44 outwardly to seal against the inside of the production string 104 and expands the slips 48, 50 so the wickers grip the inside of the production string 104 and set the plug in place. Continued pulling on the rod 58 shears off the threads 68 between the rod 58 and the device 64 thereby releasing the rod 58 which is withdrawn from the mandrel 20. This leaves a passage through the mandrel 20 and through the device 64. This feature allows the subassembly 10 to be used without modification as a ball drop plug, to be configured as the flow back plug 12 of FIG. 4 or the bridge plug 14 of FIG. 5.

It will be apparent that the subassembly 10 may be shipped to a customer along with a container including the ball check 96 and the obstruction 98 so the plug needed may be assembled in the field by a wire line operator.

Figure 6:
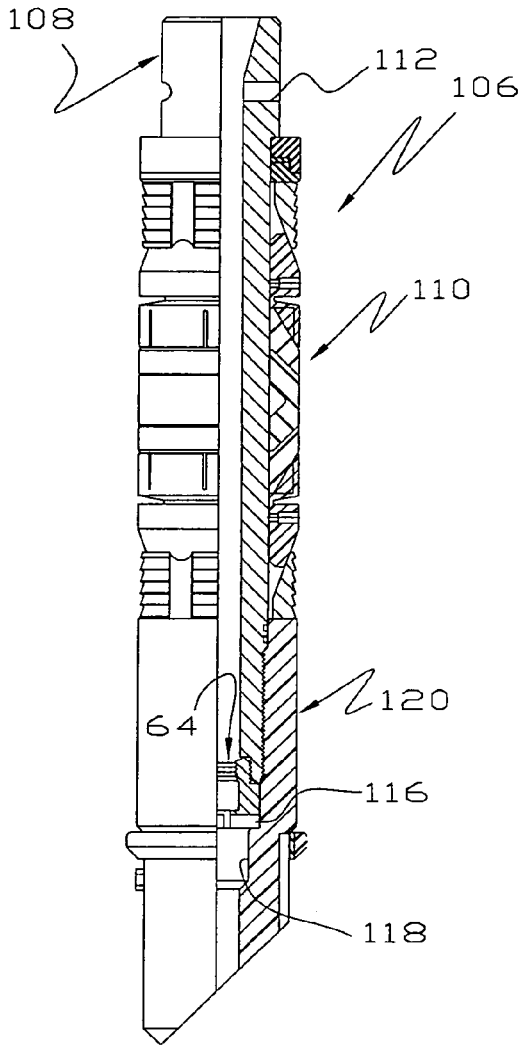
FIG. 6 is a cross-sectional view of another embodiment of a subassembly used to provide a ball drop plug, a bridge plug and/or a flow back plug.

FIG. 6 depicts another embodiment 106 which serves as a ball drop plug and which can readily be modified to provide a bridge plug or flow back plug. As illustrated, the subassembly 106 differs from the subassembly 10 mainly in a different technique for expanding the plug. More specifically, the subassembly 106 is set by pulling on the mandrel 108 and/or pushing on the slips/seal section 110. This has several consequences, one of which is that the mandrel 108 provides one or more passages 112 for receiving a shear pin (not shown) for connecting the mandrel 108 to the setting tool (not shown).

The mandrel 108 is preferably made of aluminum or other strong drillable metal so it can withstand the forces involved in setting the plug 106.

The setting device 64 no longer acts as a setting device and thus no longer requires threads but acts to provide a function in both the flow back plug version and the bridge plug version of FIG. 6. The device 64 acts as a lip for retaining a ball check where the subassembly 106 has been converted into a flow back plug analogous to FIG. 4 or an obstruction where the subassembly has been converted into a bridge plug analogous to FIG. 5. The bypass channels 116 act to allow fluid flow around a ball check placed in the chamber 118 so upward flow is allowed. It will be seen that the device 64 need not be a separate component but may comprise part of the lower end of the mandrel 108.

It will be seen that the subassembly 106 provides a mule shoe 120 which is threaded onto the mandrel 108 so a ball check analogous to the ball check 96 may be placed in the chamber 118 during assembly to convert the subassembly 106 into a flow back plug. Similarly, the removable mule shoe 120 allows an obstruction analogous to the obstruction 98 may be placed in the chamber 118 during assembly to convert the subassembly 106 into a bridge plug. Other than the technique by which the subassembly 106 is expanded, it operates in substantially the same manner as the subassembly 10.

The subassembly 106 is set in a conventional manner, i.e. a setting tool connects to the mandrel 108 through the shear pins (not shown) extending through the passage 112. As the mandrel 108 is tensioned and the slips/seal section 110 is compressed, the plug expands into sealing engagement with the production or pipe string. When sufficient force is applied, the shear pins fail thereby releasing the setting tool so it can be pulled from the well.

It will be seen that the subassembly 10 has the advantage of providing a composite plastic mandrel 20 which is less expensive and easier to drill up than the stronger mandrel 108 of FIG. 6. It will be seen that the subassembly 106 has the advantage of using conventional shear pins and a conventional manner of expanding the plugs.

Figure 7:
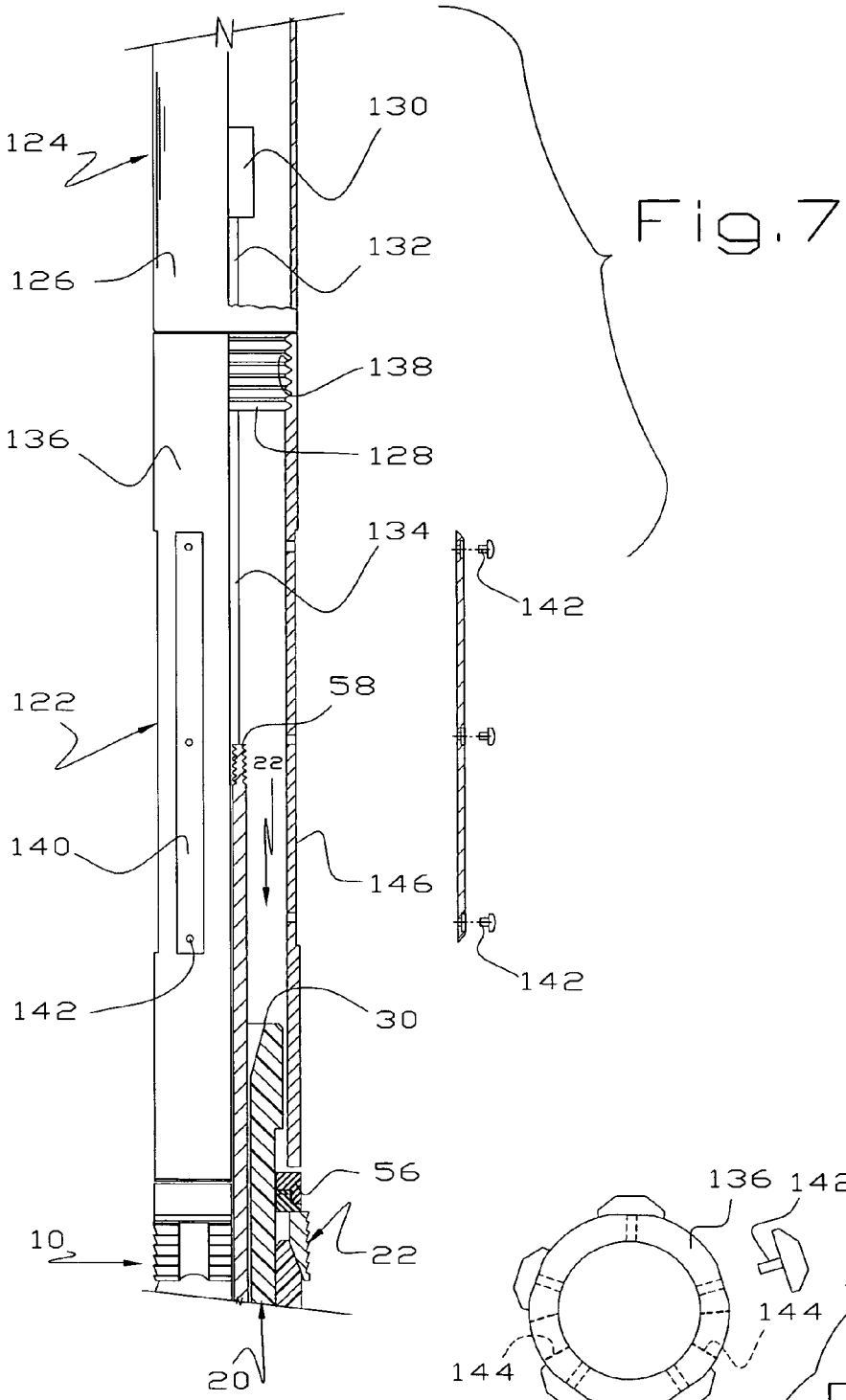
FIG. 7 is an exploded view, partly in section, of an improved adapter or sleeve used in conjunction with a conventional setting tool.
Figure 8:
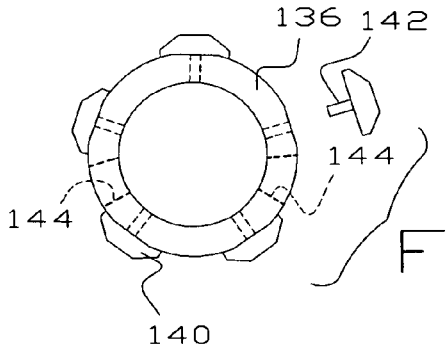
FIG. 8 is an end view of the adapter of FIG. 7.

Referring to FIGS. 7-8, there is illustrated an improved adapter 122 on the bottom of a commercially available setting tool 124. The setting tool may be of any suitable type such as an Owen Oil Tools wireline pressure setting tool or a Model E-4 Baker Oil Tools wireline pressure setting assembly. These setting tools are typically run on a wireline and include a housing 126 having male threads 128 on the lower end thereof and an internal force applying mechanism 130 which is typically a gas operated cylinder powered by combustion products from an ignition source and includes a terminal or connection 132.

The diameter and other dimensions of plugs made by different manufacturers vary but must adapt, in some manner, to conventional setting tools. Accordingly, plug manufacturers provide an internal adapter 134 for connection to the terminal 132 for applying tension to the plug and an external adapter, such as the adapter 122, for resisting upward or tension induced movement of the slips/seal section of the plug. This results, conventionally, in tension being applied to the mandrel of the plug and/or compression to the slips assembly. The internal adapter 134 connects between the terminal 132 and the setting rod 58, in the embodiments of FIGS. 1-5 or between the terminal 132 and the mandrel 108 of FIG. 6.

The adapter 122 comprises a sleeve 136 having threads 138 mating with the threads 128 thereby connecting the sleeve 136 to the setting tool 124. The lower end of the sleeve 136 rides over the O.D. of the upper mandrel end 30 of the plug 10, 12, 14 and abuts, or nearly abuts, the upper load ring 56. When the force applying mechanism 130 is actuated, the adapter 134 pulls upwardly on the setting rod 58 while the sleeve 136 prevents upward movement of the load ring 56 thereby moving the slips/seal section 22 relatively downwardly on the mandrel 20 and expanding the plug 10, 12, 14 into engagement with a production string into which the plug 10, 12, 14 has been run.

In some embodiments, the sleeve 136 includes a series of wear pads or centralizers 140 secured to the sleeve 134 in any suitable manner. One technique is to use threaded fasteners or rivets 142 captivating the centralizers 140 to the sleeve 136. In some embodiments, the centralizers 140 are elongate ribs although shorter button type devices are equally operative although more trouble to manufacture and install. In some embodiments, one or more viewing ports 144 may be provided to inspect the inside of the sleeve 136. In some embodiments, the sleeve 136 can be milled to provide a flat spot 146. In some embodiments, the base of the centralizers may be curved to fit the exterior of the sleeve 136.

In some embodiments, the centralizers 140 are made of a tough composite material such as a tough fabric embedded in a resin. In some embodiments, the fabric is woven from a para-aramid synthetic fiber such as KEVLAR manufactured by DuPont of Wilmington, Del. In use, the centralizers 140 increase the effective O.D. of the sleeve 136 or, viewed slightly differently, reduce the clearance between the O.D. of the sleeve 136 and the inside of the production string in which the plug 10 is run. This acts to center the sleeve 136 and the setting tool 124 in the production string and introduces a measure of consistency or uniformity in the setting of plugs. The force applied by the mechanism 130 is substantial, e.g. in excess of 25,000 pounds in some sizes, and it is desirable for the plug 10 to be centered in the production string.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A down hole well tool comprising a mandrel having a first passage therethrough;

a slips/seal section movable on an exterior of the mandrel from a running in position to an expanded position for sealing against a production string; and a setting assembly for assisting in moving the slips/seal section from the running in position to the expanded position, the setting assembly including a setting device at least partially disposed within the mandrel and having a second passage therethrough comprising a threaded section, and a setting rod comprising a threaded section engaged with the threaded section of the setting device, wherein pulling on the setting rod expands the slips/seal section into sealing engagement with the production string and separates the threaded section of the setting rod from the threaded section of the setting device to remove the setting rod from the mandrel, the arrangement of the setting device and setting rod being that removal of the setting rod from the mandrel opens the first and second passages, the setting device remaining rigid with the mandrel upon removal of the setting rod.

2. The down hole tool of claim 1 wherein the first passage provides a tapered inlet so a ball can be inserted into the production string to seal against the tapered inlet to prevent downward flow into the production string.

3. The down hole tool of claim 2 further comprising a ball seated against the tapered inlet preventing downward flow into the production string.

4. The down hole tool of claim 1 wherein the first passage extends completely through the mandrel and slips/seal section.

5. The down hole tool of claim 1 comprising a first end and a second end, the down hole tool being adapted to receive the setting rod through the first end and wherein the unthreaded section is between the second end and the threaded section.

6. The down hole tool of claim 1 wherein the setting device is connected to the mandrel.

7. A down hole well plug comprising a mandrel having a first passage therethrough; a slips/seal section movable on an exterior of the mandrel from a reduced diameter running in position to an expanded position for sealing against a production string; a setting assembly including a setting device rigid with the mandrel in the first passage, the setting device providing a second axial passage therethrough communicating with the first axial passage and a setting tool connected to the setting device so that tensioning the setting tool expands the plug into sealing engagement with a production string and removes the setting tool from the first and second passage, the setting device remaining rigid with the mandrel upon removal of the setting tool; and a mule shoe connected to the mandrel and having a passage therethrough communicating with the mandrel passage, the passage including a passage section, circular in cross-section perpendicular to an axis through the plug, having a first end adjacent the mandrel and a second end, and a valve seat adjacent the second end of the passage section;

the setting device providing an obstruction overlying the passage section and preventing an object in the passage section from moving toward the mandrel and providing a bypass allowing fluid flow toward the mandrel in the event there is a ball check in the passage section.

8. The down hole plug of claim 7 wherein the passage section is cylindrical.

9. A plug for isolating a wellbore, comprising a mandrel having a first end and a second end and a passage formed therethrough;

at least one sealing element disposed about the mandrel;

at least one slip disposed about the mandrel;

at least one conical member disposed about the mandrel; and an insert at least partially disposed within the bore of the mandrel proximate the second end of the mandrel, wherein:

the insert is adapted to receive a setting tool that enters the mandrel through the first end thereof;

the insert comprises one or more shearable threads disposed on an inner surface thereof;

the one or more shearable threads are adapted to engage the setting tool;

the one or more shearable threads are adapted to release the setting tool when exposed to a predetermined axial force;

the insert comprises a passage therethrough, the passage through the insert including the one or more shearable threads;

the insert comprises a shoulder disposed on an outer surface thereof, the shoulder adapted to abut the second end of the mandrel; and the insert and the mandrel being unshearable when exposed to the predetermined axial force.

10. The plug of claim 9 wherein the outer surface of the insert has a larger diameter and a smaller diameter forming the shoulder therebetween.

11. The plug of claim 9 wherein the mandrel is adapted to receive a ball that restricts flow in at least one direction through the mandrel.

12. The plug of claim 9 wherein the predetermined axial force to release the setting tool is less than an axial force required to break the mandrel.

13. The plug of claim 9 further comprising an anti-rotation feature disposed proximate a first end, a second end, or both ends of the plug.

14. The plug of claim 13 wherein the anti-rotation feature is selected from the group consisting of a taper, a mule shoe, a half mule shoe and one or more angled surfaces.

15. The plug of claim 9 wherein the plug is a frac plug.

16. The plug of claim 9 wherein the insert passage has substantially the same diameter as the mandrel passage.

17. The plug of claim 9 wherein the insert is brass.

18. The plug of claim 9 wherein the insert is threadably engaged to the mandrel through a threaded connection.

19. The plug of claim 9 further comprising an impediment to block fluid flow in both axial directions through the mandrel.

20. The plug of claim 9 wherein the plug is a bridge plug.

21. The plug of claim 9 wherein at least one of the mandrel passage and the insert passage is adapted to receive an impediment therein restricting flow in at least one direction through the mandrel.

* * * * *